US012569026B2

(12) United States Patent
Hayes et al.

(10) Patent No.: US 12,569,026 B2
(45) Date of Patent: Mar. 10, 2026

(54) MIDSOLE WITH INCORPORATED ORTHOTIC SUPPORT

(71) Applicant: Superfeet Worldwide LLC, Ferndale, WA (US)

(72) Inventors: Eric Paris Hayes, Ferndale, WA (US); Mike Zhuang, Ferndale, WA (US); Daniel Wakeland, Ferndale, WA (US)

(73) Assignee: Superfeet Worldwide LLC, Ferndale, WA (US)

( * ) Notice: Subject to any disclaimer, the term of this patent is extended or adjusted under 35 U.S.C. 154(b) by 1126 days.

(21) Appl. No.: 16/578,089

(22) Filed: Sep. 20, 2019

(65) Prior Publication Data

US 2020/0008517 A1 Jan. 9, 2020

Related U.S. Application Data

(62) Division of application No. 15/655,624, filed on Jul. 20, 2017, now Pat. No. 10,463,103.

(51) Int. Cl.
*A43B 7/14* (2022.01)
*A43B 3/00* (2022.01)
(Continued)

(52) U.S. Cl.
CPC ..... *A43B 7/1475* (2013.01); *A43B 3/0057* (2013.01); *A43B 7/141* (2013.01); *A43B 7/142* (2013.01); *A43B 7/143* (2013.01); *A43B 7/144* (2013.01); *A43B 7/1445* (2013.01); *A43B 7/24* (2013.01); *A43B 13/04* (2013.01);
(Continued)

(58) Field of Classification Search
None
See application file for complete search history.

(56) References Cited

U.S. PATENT DOCUMENTS 1,336,278 A * 4/1920 Burns ..... A43B 7/22 36/175
3,474,496 A 10/1969 Klee
(Continued)

FOREIGN PATENT DOCUMENTS

CN 103327844 A 9/2013
EP 3045066 A1 7/2016
(Continued)

OTHER PUBLICATIONS

International Search Report and Written Opinion dated Sep. 6, 2018 for PCT/US2018/030478, filed May 1, 2018; 15 pages.
(Continued)

*Primary Examiner* — Jila M Mohandesi
(74) *Attorney, Agent, or Firm* — Lowe Graham Jones PLLC

(57) ABSTRACT

A midsole of footwear with an incorporated orthotic support. The midsole includes a soft and flexible member and a more rigid orthotic support. The orthotic support includes a heel cup and an arch support portion that extends forwardly from the heel cup. Embodiments produce the midsole by positioning the orthotic insert between an upper portion of the footwear and an outsole. Then, soft and flexible material is injected into the space surrounding the orthotic. The soft and flexible material subsequently cures forming the multi-part unitary midsole.

15 Claims, 4 Drawing Sheets

(51) Int. Cl.

| | |
|---|---|
| ***A43B 7/1405*** | (2022.01) |
| ***A43B 7/142*** | (2022.01) |
| ***A43B 7/143*** | (2022.01) |
| ***A43B 7/144*** | (2022.01) |
| ***A43B 7/1445*** | (2022.01) |
| ***A43B 7/1475*** | (2022.01) |
| ***A43B 7/24*** | (2006.01) |
| ***A43B 13/04*** | (2006.01) |
| ***A43B 13/12*** | (2006.01) |
| ***A43B 13/14*** | (2006.01) |
| ***A43B 13/18*** | (2006.01) |

(52) U.S. Cl.
CPC ..... *A43B 13/125* (2013.01); *A43B 13/141* (2013.01); *A43B 13/186* (2013.01)

(56) References Cited

U.S. PATENT DOCUMENTS

| | | | | | |
|---|---|---|---|---|---|
| 3,824,716 | A | | 7/1974 | Di Paolo | |
| 4,338,734 | A | * | 7/1982 | Schwartz | A43B 7/22 36/44 |
| 4,348,821 | A | * | 9/1982 | Daswick | A43B 13/24 36/103 |
| 4,434,518 | A | | 3/1984 | Watanabe | |
| 4,439,937 | A | * | 4/1984 | Daswick | A43B 13/10 36/107 |
| 4,686,993 | A | * | 8/1987 | Grumbine | A43B 7/141 36/140 |
| 4,831,750 | A | | 5/1989 | Muller | |
| 4,862,604 | A | * | 9/1989 | Hauser | A43B 7/144 36/43 |
| 5,203,793 | A | | 4/1993 | Lyden | |
| 5,247,741 | A | | 9/1993 | Pastor | |
| 5,528,842 | A | * | 6/1996 | Ricci | A43B 21/30 36/38 |
| 5,718,064 | A | | 2/1998 | Pyle | |
| 5,722,186 | A | * | 3/1998 | Brown | A43B 7/143 36/43 |
| 5,842,294 | A | * | 12/1998 | Fabricant | A43B 7/144 36/127 |
| 6,173,511 | B1 | * | 1/2001 | Perrault | A43B 7/1425 36/173 |
| 6,205,683 | B1 | * | 3/2001 | Clark | A43B 13/12 36/102 |
| 6,219,940 | B1 | * | 4/2001 | Kita | A43B 13/026 36/31 |
| 6,282,816 | B1 | | 9/2001 | Rosendahl | |
| D489,521 | S | * | 5/2004 | Bacon | D2/961 |
| 9,259,050 | B2 | * | 2/2016 | Smith | A43B 7/148 |
| 10,165,821 | B2 | * | 1/2019 | Truelsen | A43B 7/144 |
| 2003/0140525 | A1 | | 7/2003 | Branger | |
| 2010/0293816 | A1 | * | 11/2010 | Truelsen | A43B 13/141 36/30 R |
| 2011/0030245 | A1 | * | 2/2011 | Truelsen | A43B 13/12 36/76 R |
| 2012/0159814 | A1 | * | 6/2012 | Smith | A43B 7/14 36/76 R |
| 2016/0242499 | A1 | * | 8/2016 | Droege | A43B 13/181 |
| 2017/0095036 | A1 | | 4/2017 | Chen | |
| 2017/0196304 | A1 | | 7/2017 | Haugbro et al. | |

FOREIGN PATENT DOCUMENTS

| | | | |
|---|---|---|---|
| KR | 1011322710000 | B1 | 4/2012 |
| WO | 9638062 | A1 | 12/1996 |
| WO | 199638062 | | 12/1996 |

OTHER PUBLICATIONS

First Office Action dated Mar. 23, 2021 for co-pending Chinese Patent Application No. 201880003725.2, 23 pages.
First Office Action dated Apr. 19, 2021 for co-pending Canadian Patent Application No. 3,037,209, 4 pages.
First Office Action dated Jul. 27, 2021 for co-pending Japanese Patent Application No. 2019-515537, 5 pages.
First Office Action dated Aug. 3, 2021 for co-pending Korean Patent Application No. 10-2019-7009124, 5 pages.
Office Action dated Oct. 8, 2024 for co-pending European Patent Application No. 18725996.5; 5 pages.
Notice of Reexamination dated Mar. 17, 2025 for co-pending Chinese Patent Application No. 201880003725.2; pp. 18.

* cited by examiner

MIDSOLE WITH INCORPORATED ORTHOTIC SUPPORT

PRIORITY CLAIM

The present application is a divisional of U.S. application Ser. No. 15/655,624 entitled MIDSOLE WITH INCORPORATED ORTHOTIC SUPPORT and filed Jul. 20, 2017.

FIELD OF THE INVENTION

This disclosure generally relates to footwear, and more particularly to footwear with orthotic devices incorporated into sole assemblies.

BACKGROUND OF THE INVENTION

Footwear is often designed without proper support for the human foot. This is especially true if the foot is affected by one of many common ailments. This lack of support is often addressed by orthotic inserts (also referred to as "orthotics"), that are devices placed in footwear to cooperate with the plantar surfaces of a wearer's feet. The inserts enhance one or both of comfort and support.

The ability to remove orthotic inserts is advantageous in certain situations because it allows wearers to conveniently switch inserts from one pair of footwear to another. However, removable inserts can be easily misplaced or lost. In addition, orthotic inserts can become dislodged or misaligned during use, thereby diminishing their effectiveness. Many orthotic inserts are designed as aftermarket products that must fit a wide variety of footwear. The design of the orthotic is limited by conforming to generic footwear. For example, many orthotic inserts must be designed with a limited height to allow them to fit into the foot compartment of footwear.

SUMMARY OF THE INVENTION

Footwear with orthotic support incorporated into the sole assembly provide the support of orthotic inserts but in a fixed and durable package. An orthotic support incorporated within an article of footwear cannot shift while in use or be lost by a user. The incorporation of orthotics into the sole assembly creates many design possibilities that cannot be realized with removable orthotic inserts. The footwear with incorporated orthotic provide proper support when purchased by the consumer without having to add an insole or orthotic after purchase of the footwear.

At least one embodiment of the invention may be summarized as an orthotic support incorporated within a midsole. The midsole is formed of a soft and flexible material that surrounds and holds the orthotic support in position. The orthotic features a heel cup and curvature to support the arch of a foot.

The orthotic features portions that are shaped to interact with particular surfaces of a foot. The heel cup supports the heel of a user. The curvature of the cup compliments the curvature of a heel and contributes to creating a proper fit. The orthotic extends forward through the arch of the foot and has curvature that supports the arch. The curvature of the heel cup and arch support can be designed to fit a specific user, foot ailment, or other parameter. One embodiment of the invention includes an orthotic support with a length that extends from the back of the heel cup through the arch support. This length allows for flexibility of the footwear forward of the orthotic. Other embodiments may include orthotics that are approximately the length of the midsole. Different materials or thicknesses can be used along the length, width, and thickness of the orthotic to allow desired flexibility and support in various regions.

The orthotic may increase the rigidity of the footwear. It is preferably composed of a material that is substantially more rigid than the flexible material surrounding it. One embodiment uses nylon, a material commonly used for orthotics, but many others may be used. The rigidity of the material provides support to the plantar surfaces of the foot. This support contributes to optimal functioning of a foot. The orthotic may increase one or both of the flexural and torsional strength of the midsole. The rigidity of the orthotic support may be designed to provide proper support for specific foot ailments, foot shapes, or other parameters.

The rigidity of footwear may also be increased using shanks. Shanks are commonly linear metal components that are positioned approximately parallel to the longitudinal axis of footwear. In one embodiment of the invention, a shank may be incorporated into the midsole with an orthotic insert to provide further rigidity. In other embodiments, the orthotic support may provide the rigidity of a traditional shank.

The rigidity of the footwear may also be designed for by altering other aspects of the footwear. In one embodiment, the thickness of the orthotic may be increased in high stress areas. Other embodiments may use stiffer materials or shape the orthotic to increase rigidity. Embodiments may also include flexible areas, such as flex grooves, that align with bending points in the foot. These flexible areas may be designed by reducing thickness or reducing cross sectional area. Some embodiments may choose material rigidity based on the application of the footwear. Other embodiments may use multiple materials with different rigidities to form a midsole.

The material that surrounds the orthotic is preferably substantially softer and more flexible than the orthotic. A common material used in this type of application is polyurethane but many other materials may be used. This soft and flexible material holds the orthotic in position. Some embodiments feature hollow space within the orthotic that the soft and flexible material may passes through. The material that passes through the hollow space further secures the orthotic in position. The shape, thickness, and rigidity of the soft and flexible material may be varied, similarly to the orthotic. Embodiments may include a midsole with increased thickness of the flexible material at locations that require high rigidity. Embodiments may also include decreased thickness of the material in areas that require flexibility, such as the toe box. Some embodiments may feature midsoles with different rigidity based on the intended use of the footwear. An embodiment of an athletic shoe may feature a more flexible midsole material than an embodiment of a work boot.

Midsoles come in a wide variety of shapes according to the intended use of the footwear. Embodiments will likewise vary in shape.

The midsole may be produced in several ways. In one embodiment, the orthotic support is held in place by structures extending from the bottom surface of the upper portion of the footwear. These structures hold the orthotic support in a fixed position between the upper portion and an outsole of the footwear. A material then flows into the space between the upper portion and the outsole, surrounding the orthotic support. This material cures forming a midsole with the orthotic support incorporated within it. Other embodiments may feature the orthotic support being held in place by structures extending from the outsole. In other embodiments, the upper portion of the footwear may be replaced by other surfaces. Further embodiments may replace the outsole with a different lower surface.

Some embodiments include hollow space in the orthotic support that allows the flowing material to pass through it. This material subsequently cures and contributes to securing the orthotic support in position.

The method of producing the midsole may also affect the rigidity of the sole assembly. In an embodiment, the material reaction rate may be varied with time producing different thicknesses along the length of the midsole of the footwear. Varying the thickness allows for the creation of specific areas of flexibility and rigidity. In further embodiments, a shank may also be incorporated into the midsole. The shank may be positioned below the orthotic. The flowing material would surround the shank and orthotic incorporating them into the midsole.

BRIEF DESCRIPTION OF THE DRAWINGS

Preferred and alternative examples of the present invention are described in detail below with reference to the following drawings.

DETAILED DESCRIPTION

In the following description, certain specific details are set forth in order to provide a thorough understanding of various disclosed embodiments. However, one skilled in the relevant art will recognize that embodiments may be practiced without one or more of these specific details. In other instances, well known structures and manufacturing techniques associated with footwear and orthotic devices may not be shown or described in detail to avoid unnecessarily obscuring descriptions of the embodiments.

Unless the context requires otherwise, throughout the specification and claims that follow, the word "comprise" and variations thereof, such as, "comprises" and "comprising" are to be construed in an open, inclusive sense, that is as "including, but not limited to."

Unless otherwise stated, the following terms shall refer to the stated descriptions. The length of the footwear shall refer to an axis extending from the heel portion of the footwear through the toe portion of the footwear. The width of the footwear shall refer to an axis approximately perpendicular to the length axis and approximately parallel to the bottom surface of the footwear. The thickness of the footwear shall refer to an axis perpendicular to the length and width of the footwear.

Figure 1:
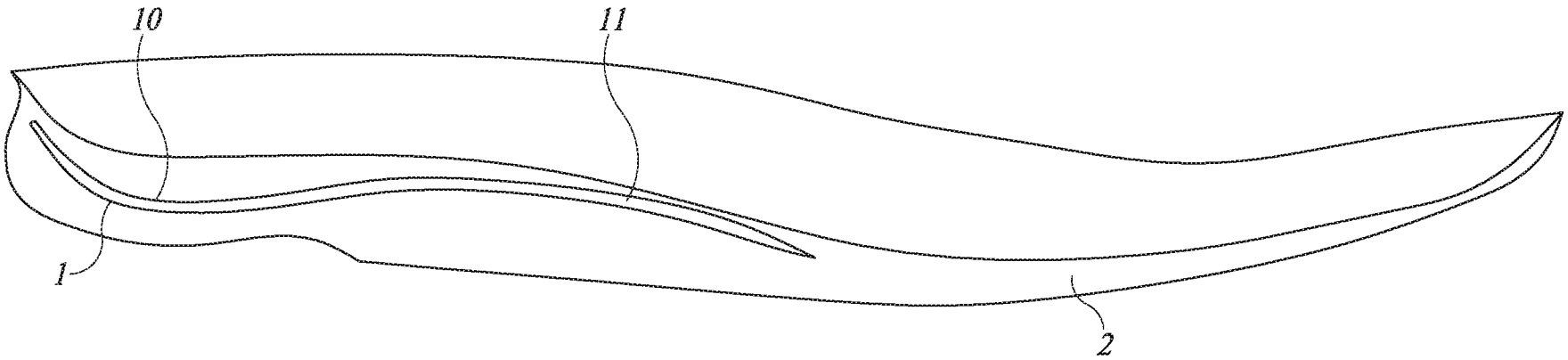
FIG. 1 shows a side view of an embodiment of a midsole.

FIG. 1 depicts a side view cross section of an embodiment of a footwear midsole. The figure depicts an orthotic insert 1 surrounded by soft and flexible material 2. The heel cup 10 is shown in the rear of the footwear. The arch support portion 11 is shown extending forward from the rear portion. One embodiment of the curvature of the arch support portion 11 is shown in FIG. 1. However, the arch support portion of the orthotic could be formed using many different curvatures to support different types and/or shapes of feet or alleviate different foot ailments.

FIG. 1 also depicts an embodiment of a possible length of an orthotic support. FIG. 1 depicts the orthotic insert terminating after the arch support. This configuration allows for increased flexibility of the midsole member in the forward portions of the footwear. Other embodiments may include different lengths to provide support to other areas of the foot.

FIG. 1 also depicts an embodiment of the invention with varying thickness of the midsole. The forward portion of the midsole is depicted as having less cross-sectional thickness than the rearfoot or middle portions of the midsole. A thinner forward portion of the midsole may provide greater flexibility. Higher flexibility is desirable in applications including athletic shoes. Other embodiments may vary thickness differently than depicted in FIG. 1. The thickness variation may be based on intended application of the footwear or other design parameters.

The thickness of the orthotic insert may also be varied. The thickness variation of the orthotic insert may be varied in conjunction with or independently of the thickness variation of the flexible material. FIG. 1 depicts varying the thickness of both the orthotic insert and flexible material. The orthotic insert 1 is illustrated to have a tapered thickness as it extends to the front of the footwear. The flexible material 2 has greater thickness in the heel portion of the footwear. Other embodiments of the invention may use thickness variation of the components to provide support in different areas of the footwear.

Varying the thickness of the midsole members allows for the characteristics of the midsole to be designed for specific areas of a foot. One embodiment of the invention may include a thicker section of the arch support portion of the orthotic insert. This thicker section may provide support to a specific area of the foot to correct for a foot ailment. Another embodiment may include thicker flexible material in the rearfoot portion of the midsole to provide great shock absorption. The thickness of both members may be varied in different portions of the footwear to tailor the characteristics of the footwear to an intended purpose, a specific foot, a specific foot ailment, or other design parameters.

The characteristics of the midsole may be varied in other ways. An embodiment of the invention may include an orthotic insert composed of multiple materials with different rigidities. Other embodiments may use an orthotic insert material to provide a rigidity based on the intended use of the footwear. Embodiments may also vary the shape of the orthotic insert. One embodiment may reduce the width of the orthotic insert to provide greater torsional flexibility. Other preferred embodiments vary the thickness of the flexible material 2 above the orthotic 1. More cushion above the orthotic 1 can be used for a comfort application, while slightly less material above the orthotic or a firmer flexible material 2 above the orthotic may be used for a more performance-oriented application, for example.

Some embodiments of the invention may design the rigidity, thickness, material selection, shape, and other parameters based on the foot of a specific user. A user may have their foot measured by one or more of several methods such as a scan, dynamic pressure assessment, or plaster mold. These measurements may then be analyzed and used to create a footwear with support designed for a specific foot. Other embodiments may vary the characteristics of the midsole based on a specific foot ailment, shape, or other parameter. An example may include a midsole with an orthotic insert shaped to prevent overpronation of a foot.

Still further embodiments may vary the design parameters of the footwear based on intended use. One embodiment may include a footwear designed for use as a work boot including a high degree of thickness of the midsole to provide support and shock absorption. Still further embodiments may design footwear based upon the analysis of the gait of an individual.

Figure 2:
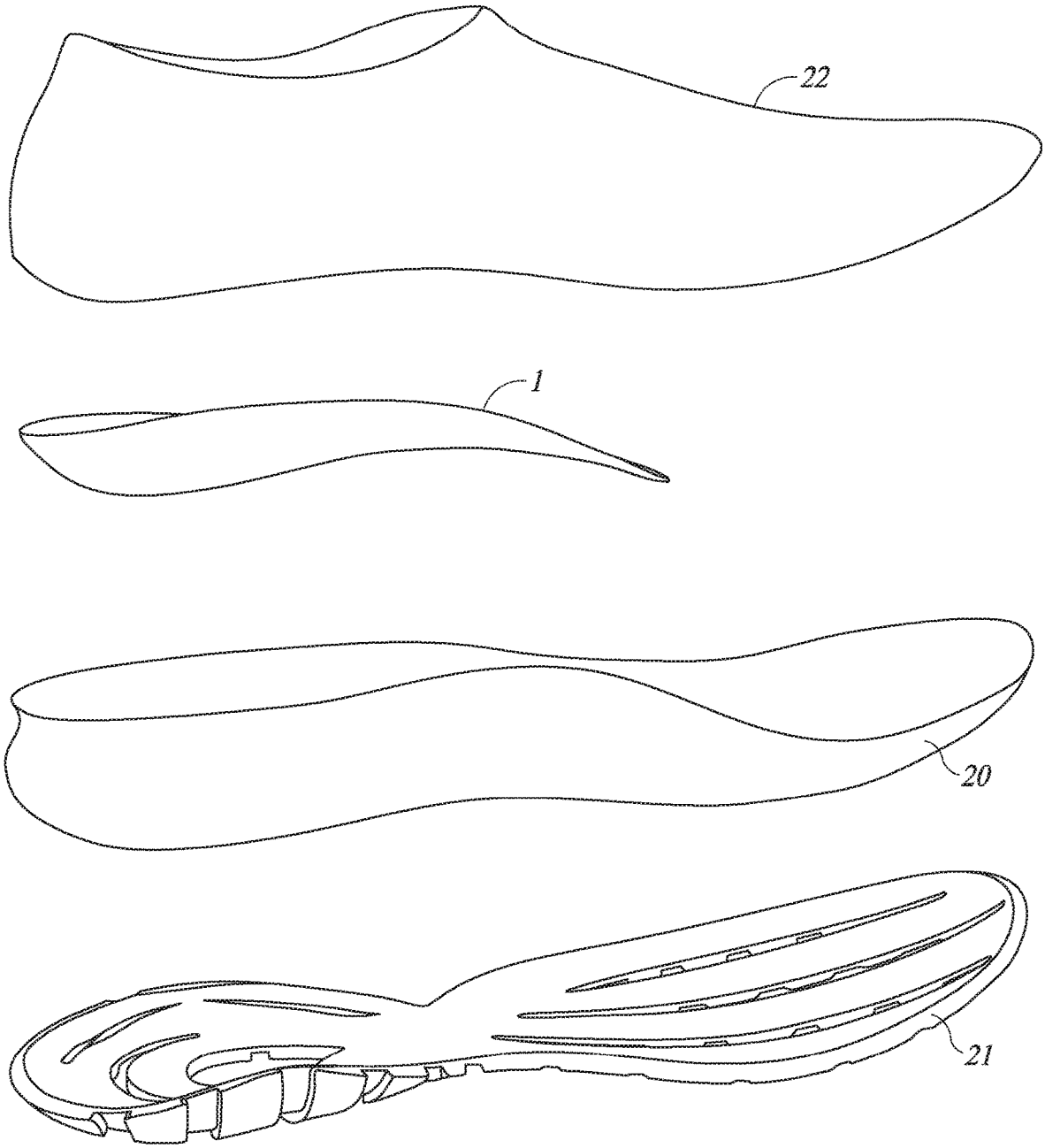
FIG. 2 shows an exploded view of the orthotic insert, soft and flexible material, upper portion of the footwear, and outsole.

FIG. 2 depicts an exploded view of the sole assembly of the footwear. This figure shows the orthotic insert 1 separately from a midsole member 20 composed of soft and flexible material 2. The figure also shows an outsole member 21 and upper portion 22.

Figure 3:
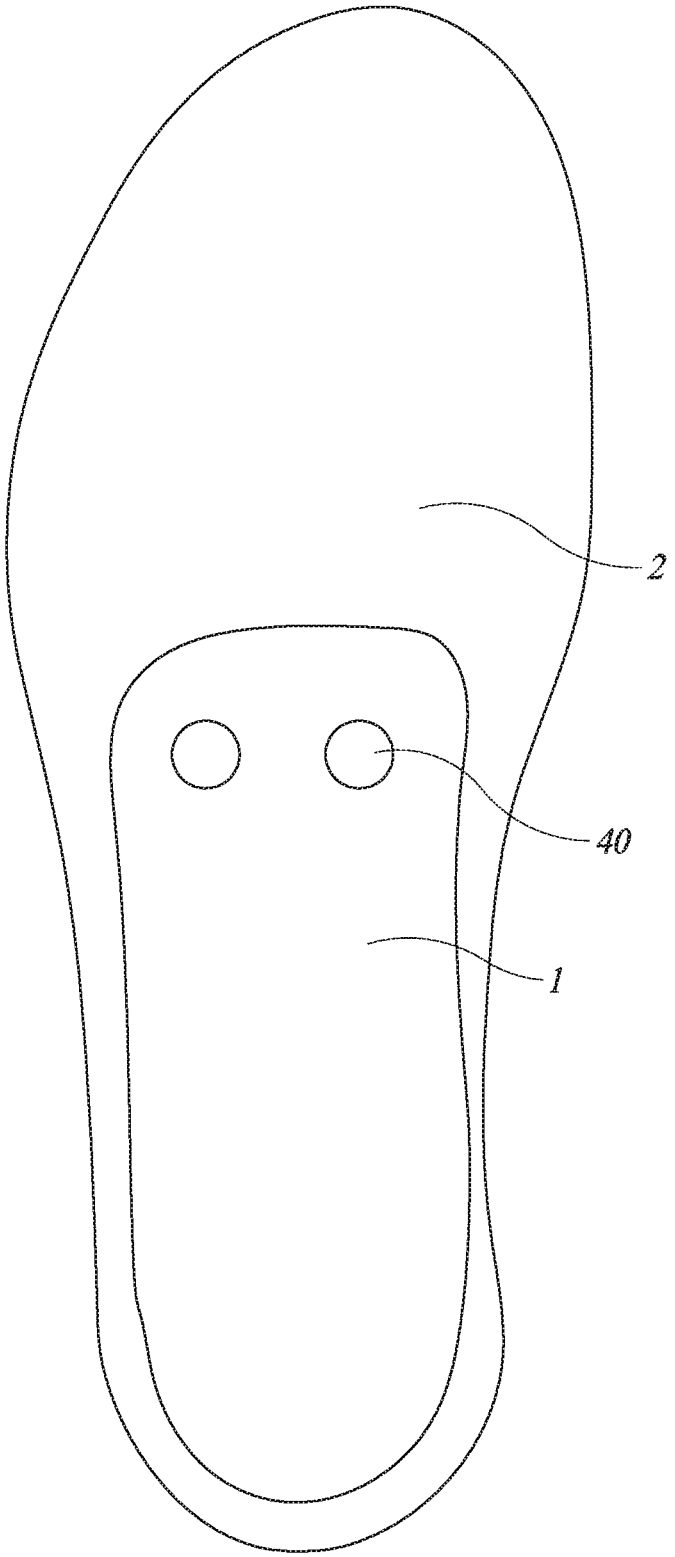
FIG. 3 shows a top view of the orthotic, including hollow space, and the flexible material.

FIG. 3 depicts a top view of an embodiment of a midsole of a footwear. This figure illustrates the shape of the orthotic 1 and soft and flexible material 2. FIG. 3 depicts an embodiment of hollow spaces 40 passing through the thickness of the orthotic insert. Other embodiments may use a different number of hollow spaces, different shaped spaces, spaces differently oriented, or other variations. Some embodiments may include the soft and flexible material of the midsole passing through these hollow spaces 40. The material passing through the hollow space in the orthotic insert may help to hold the insert in place.

Figure 4:
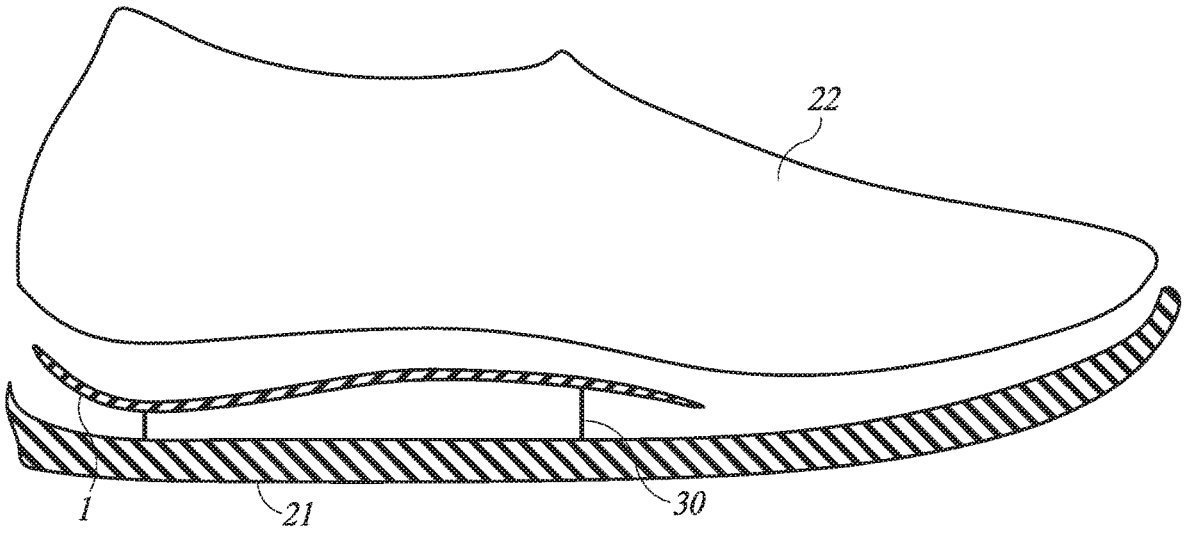
FIG. 4 shows an embodiment of a method of production.

FIG. 4 depicts a view of a configuration that may be used to produce the footwear. The figure depicts an upper portion of the footwear 22, an orthotic 1, and an outsole 21. The outsole is the portion of the footwear that contacts the ground. FIG. 4 depicts an embodiment that holds the orthotic 1 in place a distance from the top surface of the outsole. This embodiment positions the orthotic using structures 30 extending from the top surface of the outsole. In this embodiment, the upper portion of the footwear is positioned such that the orthotic is between the outsole and upper portion. One embodiment of the invention includes injecting a flowing material into the space that surrounds the orthotic insert that is positioned between the outsole and upper portion. This material subsequently cures creating a midsole of the footwear with an incorporated, embedded orthotic. Other embodiments may include using structures extending from the bottom surface of the upper portion or extending from an outside structure to secure the orthotic in position.

FIG. 4 depicts an orthotic insert with heel cup in the rearfoot portion of the footwear. FIG. 4 also depicts an orthotic with a curvature that supports the arch of the foot. Some embodiments may include an orthotic with incorporated hollow space. Other embodiments may include the flowing material passing through these hollow spaces and subsequently curing within the hollow spaces.

Some embodiments may adjust the reaction rate of the material with time. This method could be used to vary the thickness along the length of the footwear. An embodiment may inject the material from the rear of the footwear and increase the reaction rate after a predetermined time. This embodiment could be employed to create a midsole with a rear portion that is thicker than the front portion. Other embodiments may vary the reaction rates in other ways to create thickness in a predetermined area of the footwear.

Figure 5:
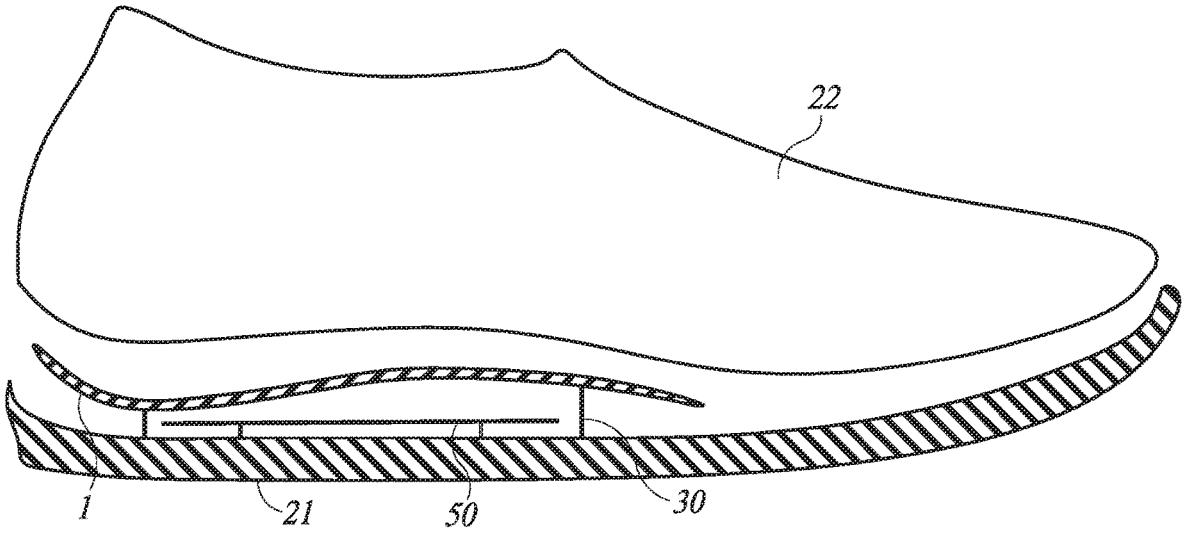
FIG. 5 shows a midsole encapsulating both an orthotic and a shank.

FIG. 5 depicts an embodiment with an orthotic 1 and shank 50 incorporated into the midsole. The orthotic 1 and shank 50 are held in place between the upper portion of the footwear 22 and the outsole 21 by structures 30. A material is caused to flow into the space surrounding the orthotic 1 and shank 50. The material subsequently cures forming the midsole.

Shanks are commonly used in footwear to increase rigidity. An incorporated shank would be held in place by the soft and flexible material. One embodiment may include a rigid support member that is a long flat metal member approximately aligned with the lengthwise axis of the footwear. Other embodiments may include rigid support members comprised of different materials, of different shapes, or in different orientations. In some embodiments, the shank includes holes through that the flexible midsole material may flow during production.

While the preferred embodiment of the invention has been described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. An article of footwear having at least an upper portion, an outsole, and a midsole, the midsole comprising:

an orthotic having a heel end with concave heel curvature relative to the top of the footwear, the curvature following the shape of the underside of a heel of a foot across at least a majority of the underside of the heel; and a midsole material being softer than the orthotic and being positioned above and below the orthotic such that the orthotic is suspended by the midsole material between the upper and the outsole, the orthotic being within approximately a middle third portion of the midsole material along the entire extent of the orthotic.

2. The article of claim 1, wherein the midsole material completely encapsulates the orthotic such that it does not directly contact the outsole or the upper, the thickness of the midsole material on all sides of the orthotic being thicker than the orthotic itself.

3. The article of claim 1 wherein the orthotic has hollow space within a forward portion thereof, the hollow space extending completely through a thickness of the orthotic.

4. The article of claim 1 wherein the orthotic has a forward portion with convex curvature relative to the top of the footwear, the orthotic extending forward with a forward end rearward of a region of the footwear for a ball of the foot of a wearer.

5. The article of claim 1 wherein a rigid support member is encapsulated in the midsole material in addition to the orthotic, the rigid support member being surrounded by the midsole material both above and below.

6. An article of footwear having at least an upper portion, an outsole, and a midsole, the midsole comprising:

an orthotic having a heel end with concave curvature relative to the top of the footwear, the curvature following the shape of the underside of a foot; and a midsole material being softer than the orthotic and being positioned above and below the orthotic such that the orthotic is suspended by the midsole material between the upper and the outsole, the orthotic being positioned within a middle third portion of the midsole material between the outsole and the upper portion.

7. The article of claim 6, wherein the midsole material completely encapsulates the orthotic such that it does not directly contact the outsole or the upper, the thickness of the midsole material above the orthotic is greater than the thickness of the orthotic.

8. The article of claim 6, wherein the orthotic has hollow space extending vertically through the orthotic at a forward portion thereof.

9. The article of claim 6, wherein the orthotic has a forward portion with convex curvature relative to the top of the footwear, a forward end of the orthotic being rearward of a portion of the footwear for receiving a ball of the foot.

10. The article of claim 6, wherein a rigid support member is encapsulated in the midsole material in addition to the orthotic, the midsole material being above and below the rigid support member.

11. The article of claim 6, wherein the orthotic is suspended within approximately a middle third portion of the midsole material.

12. The article of claim 6, wherein the orthotic further comprises a forward portion forward of the heel end and positioned to extend under a ball of a foot, the forward portion having at least one hole extending therethrough.

13. The article of claim 12, wherein the forward portion has a curvature substantially matching the curvature of the underside of a forward portion of a foot, a rearward portion of the orthotic following the contour of the bottom and mid portion of a heel of a foot.

14. The article of claim 13, wherein the forward portion extends forwardly through the approximate length of an arch support.

15. The article of claim 6, the midsole further comprising a rigid support member positioned between the outsole and the orthotic, the midsole material extending between a bottom of the rigid support member and the outsole.

* * * * *